US005513872A

United States Patent [19]

Arduin et al.

[11] Patent Number: 5,513,872

[45] Date of Patent: May 7, 1996

[54] INTERFACE DEVICE TO MODIFY THE NATURAL PRESSURE DISTRIBUTION OF A SKI ON THE SNOW

[75] Inventors: Joël Arduin, Metz-Tessy; Jacques Le Masson, Cran-Gevrier; Pierre Szafranski, Metz-Tessy; Bernard Couderc, Annecy, all of France

[73] Assignee: Salomon S.A., Metz-Tessy, France

[21] Appl. No.: 389,595

[22] Filed: Feb. 16, 1995

Related U.S. Application Data

[63] Continuation-in-part of Ser. No. 280,548, Jul. 25, 1994, which is a continuation-in-part of Ser. No. 911,702, Jul. 10, 1992, Pat. No. 5,332,253.

[30] Foreign Application Priority Data

| | | | |
|---|---|---|---|
| Aug. 27, 1991 | [FR] | France | 91 10895 |
| Feb. 16, 1994 | [FR] | France | 94 01898 |

[51] Int. Cl.[6] ..... A63C 5/07

[52] U.S. Cl. ..... 280/602; 280/607; 280/618; 280/634

[58] Field of Search ..... 280/602, 607, 280/617, 618, 634, 633, 636

[56] References Cited

U.S. PATENT DOCUMENTS

| | | | |
|---|---|---|---|
| 2,258,046 | 10/1941 | Clement | 280/602 |
| 3,260,532 | 7/1966 | Heuvel | 280/602 |
| 4,139,214 | 2/1979 | Meyer | 280/607 |
| 4,568,100 | 2/1986 | Eriksson | 280/602 |
| 4,696,487 | 9/1987 | Girard | 280/602 |
| 4,896,895 | 1/1990 | Bettosini | 280/607 |
| 5,135,250 | 8/1992 | Abondance et al. | 280/617 |
| 5,251,923 | 10/1993 | Stepanek et al. | 280/602 |
| 5,332,253 | 7/1994 | Couderc et al. | 280/602 |
| 5,397,149 | 3/1995 | Couderc et al. | 280/602 |

FOREIGN PATENT DOCUMENTS

| | | | |
|---|---|---|---|
| 1270867 | 6/1990 | Canada . | |
| 0182776 | 5/1986 | European Pat. Off. . | |
| 0183586 | 6/1986 | European Pat. Off. . | |
| 0409749 | 1/1991 | European Pat. Off. . | |
| 0492658 | 7/1992 | European Pat. Off. . | |
| 0530449 | 3/1993 | European Pat. Off. . | |
| 0556610 | 8/1993 | European Pat. Off. . | |
| 0567780 | 11/1993 | European Pat. Off. . | |
| 1109560 | 1/1956 | France | 280/602 |
| 1433242 | 12/1966 | France | 280/602 |
| 2338720 | 8/1977 | France . | |
| 2448360 | 9/1980 | France | 280/602 |
| 2654636 | 5/1991 | France . | |
| WO83/03360 | 10/1983 | WIPO . | |
| WO88/01189 | 2/1988 | WIPO | 280/602 |
| WO93/11838 | 6/1993 | WIPO . | |
| WO93/14837 | 8/1993 | WIPO . | |

*Primary Examiner*—Christopher P. Ellis
*Attorney, Agent, or Firm*—Greenblum & Bernstein

[57] ABSTRACT

The invention relates to an interface device between a boot and a ski for modifying in a dynamic manner the pressure distribution of the ski on the snow. The device includes two binding elements, a mobile sensor, a return rocking device, and an element affixed to the ski. The rocking device is arranged to transform a vertical bias exerted on the sensor into a traction bias exerted on the element affixed to the ski. In reaction, a traction bias of the same type can be transmitted towards the rear of the ski.

11 Claims, 9 Drawing Sheets

21
19
22
26
23
15
24a
24
25

INTERFACE DEVICE TO MODIFY THE NATURAL PRESSURE DISTRIBUTION OF A SKI ON THE SNOW

CROSS-REFERENCE TO RELATED APPLICATIONS

This application is a continuation-in-part of U.S. patent application Ser. No. 08/280,548, filed on Jul. 25, 1994, the disclosure of which is hereby incorporated by reference thereto in its entirety, which is a continuation-in-part of U.S. patent application Ser. No. 07/911,702, filed on Jul. 10, 1992, now U.S. Pat. No. 5,332,253, issued on Jul. 26, 1994, the disclosure of which also is hereby incorporated by reference thereto in its entirety.

BACKGROUND OF THE INVENTION

1. Field of the Invention

The invention relates to an interface device between a boot and a ski for modifying the natural pressure distribution of a ski on its gliding surface. The invention also relates to a ski equipped with the interface device.

2. Description of Background and Relevant Information

Skis that are used for alpine skiing are comprised of relatively long beams on which the boots of the skier are retained by front and rear binding elements. The boots and the binding elements are located approximately in the median zone of the ski. At rest, the skis themselves have a natural camber, by which the median zone is naturally raised with respect to the front end of the ski, or shovel, and the rear end of the ski, or tail. In addition, the skis have a flexibility that is due to their internal structure. During skiing, the ski is deformed in an elastic manner in response to the different forces to which it is subjected by the skier, but also by the ground on which it glides.

Interface devices exist that are interposed between the binding elements and the ski. Such interfaces are, for example, known according to International Patent Publication No. WO 83/03360, European Patent Publication No. 0,492,658, and European Patent Publication No. 0,409,749. These devices modify the flexibility of the beam of the ski, by stiffening it, or with a shock absorbing effect. However, these devices act in a passive manner, i.e., they only react to a predetermined bending of the ski.

Also known according to European Patent Publication No. 0,530,449, commonly owned with the instant application, is an interface device that modifies in a dynamic fashion the pressure distribution of the ski on the snow, as a function of the vertical forces that the skier exerts on his or her skis. This device includes a vertically movable sensor element that transmits to the base of the front binding element the vertical biases that it captures issuing from the boot. These biases are transmitted by means of a rocking device, and in one of the embodiments by means of a substantially horizontal linkage plate journalled on one side to the rocking device and on the other side to the base of the binding.

This device provides good results because of its dynamic nature, but it does not suit all situations or all types of skis. Namely, it lacks effectiveness in turn initiation.

According to French Patent Publication No. 2,654,636, a device is known that exerts an action on the camber of the ski by a traction effect on a linkage that connects the front and rear binding elements. This device has, in addition, a means to select the magnitude according to which it acts on the camber of the ski. Its action is limited, however, to a passive modification of the camber of the ski.

SUMMARY OF THE INVENTION

One of the objects of the invention is to provide an interface device that has a dynamic action on the distribution of the ski on the snow and that improves the turning characteristic of the ski, especially during turn initiation.

Another object of the invention is to provide an interface device that is adaptable to a standard ski.

Another object of the invention is to provide an interface device that is relatively simple to construct.

These objects, and other objects that will appear in the description to follow, are achieved by the device according to the invention, which comprises a sensor adapted to capture the vertical biases of the boot, a return rocking device that transforms the vertical biases captured by the sensor into at least a horizontal force, and a linkage member to transmit this horizontal force to an element intended to be affixed to the ski. The return rocking device is arranged to transform a vertical downward bias captured by the sensor into a horizontal traction force transmitted by the linkage member to the ski.

According to a preferred characteristic of the invention, the mobile sensor is located beneath the front of the boot, and therefore, it is more sensitive to the pressure variations of the front of the boot on its support. Such a variation occurs in a substantial manner at the moment where the skier gives an impulse to initiate a turn.

BRIEF DESCRIPTION OF THE DRAWINGS

The invention will be better understood by referring to the description below and to the attached drawings that comprise an integral part thereof.

DETAILED DESCRIPTION OF THE PREFERRED EMBODIMENTS

Figure 1:
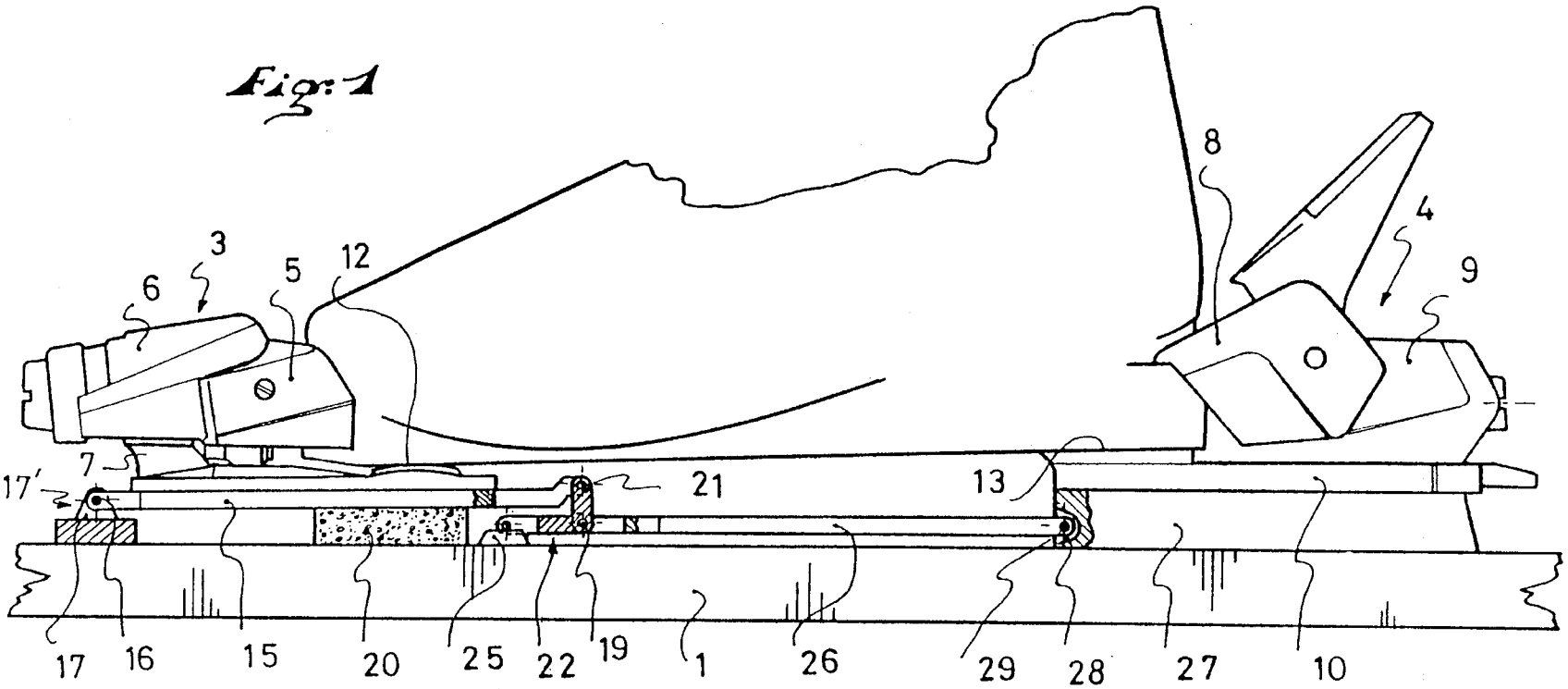
FIG. 1 represents a side view of an interface device according to a first embodiment of the invention.

FIG. 1 represents a ski 1, seen from the side in its median zone. Binding elements 3 and 4 are mounted on the ski in this median zone.

Binding elements 3 and 4 are of any appropriate type. Front binding element 3 has in a known manner a jaw 5 for retaining the front end of the boot. The jaw is borne by a body 6, and the body is itself mounted on a base 7 by which the binding element is assembled to the ski.

In a similar way, rear binding element 4 has a jaw 8 borne by a body 9. The body 9 is slidably mounted along a slide-shaped base 10 oriented along the longitudinal direction of the ski, and a spring, i.e., a return spring, elastically biases the body forward.

To each binding element 3, 4 a support element 12, 13 is also connected, on which the sole of the boot rests.

The interface device which is the object of the present invention is located in the median zone of the ski.

The device includes a sensor element that is movable along a substantially vertical direction. In the embodiment illustrated in FIG. 1, the sensor is formed by the support element 12 on which the front end of the sole of the boot rests.

In a known manner, the support element 12 rearwardly extends base 7 of the binding element, and the assembly formed by the base and the support element is mounted on a base plate 15 which is journalled in its front portion about a transverse axle or pin 16 borne by a bearing 17 connected in a fixed manner to the ski.

Figure 2:
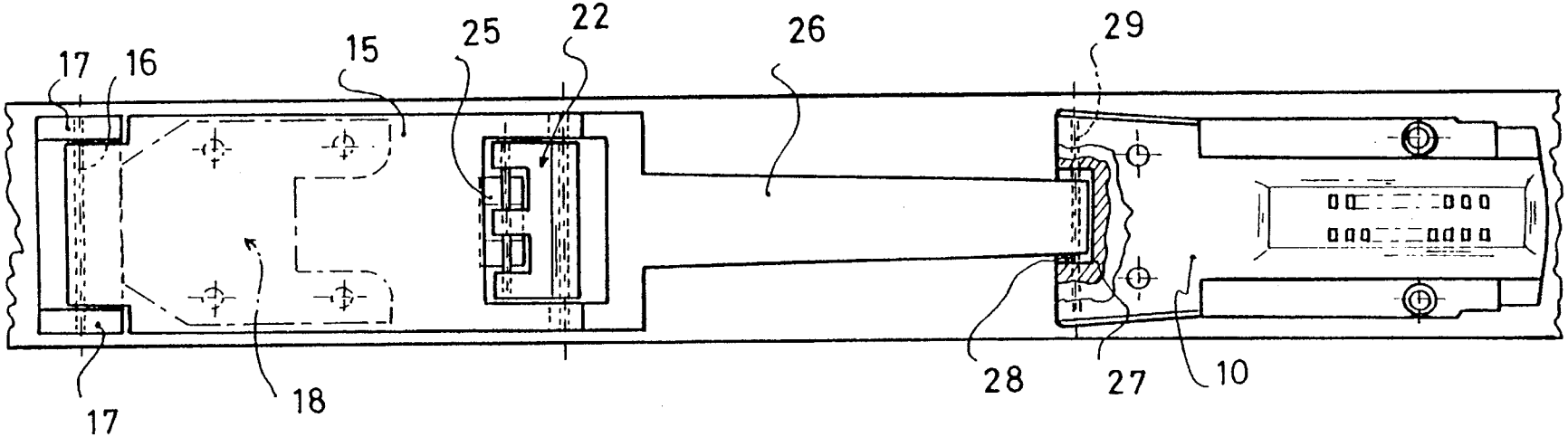
FIG. 2 represents a top view of the device of FIG. 1.

As is visible in FIG. 2, the base plate 15 has a generally rectangular shape that extends in an approximately horizontal plane, and it has at its upper surface a mounting zone 18 on which the front binding element is assembled. The base plate is naturally inextensible so as to transmit to the ski, by means of axle 16 and bearing 17, the traction biases that are applied to its rear end.

Journal axle 16 is mounted to a linkage zone 17' of bearing 17 so that it is raised with respect to the upper surface of the ski and the base plate 15 is itself raised with respect to the upper surface of the ski.

Possibly, a shock-absorbing means such as a block 20 of elastically deformable material is interposed between the upper surface of the ski and the base plate. The material can have shock-absorbing or visco-elastic properties. Block 20 contributes to maintaining the base plate in a horizontal position, and it elastically resists its rotation about axis 16.

Any other journal means besides an axle is suitable to assure the substantially vertical movement of the rear end of the base plate and of the sensor.

The rear portion of the base plate is connected to a rocking device 22 by a journal about a transverse axle 21.

The rocking device functions to send back towards the base plate along a horizontal direction the vertical efforts applied on the sensor 12.

The rocking device 22 has two approximately perpendicular arms, one approximately vertical arm 23, and one approximately horizontal arm 24.

In the position where the rocking device is represented, the journal axle 21 with the base plate 15 is located at the top of vertical arm 23. Horizontal arm 24 extends forward, and its front end is in support against a pin 25 which is connected in a fixed manner to the ski. Preferably, the support of the rocking device on pin 25 is advantageously materialized by a transverse pin **24*a* located at the front end of the arm 24. This pin facilitates the rotation of the rocking device by support on pin 25**.

The lower end of vertical arm 23 of the rocking device is retained along a horizontal direction by a longilinear traction member 26 that extends from the rear of the ski.

In the embodiment illustrated, the traction member 26 is connected to the rocking device 22 about an axle 19. The traction member 26 is naturally inextensible. It is connected towards the back to a rear base plate 27 that is located beneath the base 10 of the rear binding element, and that is affixed to the ski. Its rear end penetrates into a housing 28 of the base plate 27, and it is assembled to the base plate by a pin 29.

Any other appropriate linkage means is suitable. In particular, given that traction member 26 works primarily by traction, it is possible to obtain it in the form of a ribbon or inextensible but deformable cable. The journal linkages of member 26 to the rocking device and to the base plate 27 could be replaced by affixing the ends of the ribbon or cable respectively to the rocking device and to the base plate, the relative movement between these elements necessary to the operation of the device issuing from the deformation of the ribbon or of the cable.

Also, the rear end of the traction member 26 could be affixed not to the rear base plate 27, but directly to the ski in front of the base plate, or to the base 10 of the binding element. In any case, it is important that the traction member 26 be connected to a fixed point on the ski. The height at which the traction member 26 is connected to the ski determines the lever arm with which a force carried by the traction member will be transmitted to the ski.

Thus, a vertical bias exerted on the sensor, for example during front support in turn initiation, forces the rocking device to rock with respect to the pin 25 about the end of its horizontal arm 24. As the journal axle 19 to traction element 26 is retained from the rear, journal axle 21 is forced to return, which induces in the base plate 15 a traction bias that is transmitted to the ski by the bearing 17. In reaction, the traction member 26 transmits towards the rear of the ski a traction bias which in turn induces on the rear end of the ski a flexion moment which tends to lift the end in question. The block 20 is also compressed.

Figure 3:
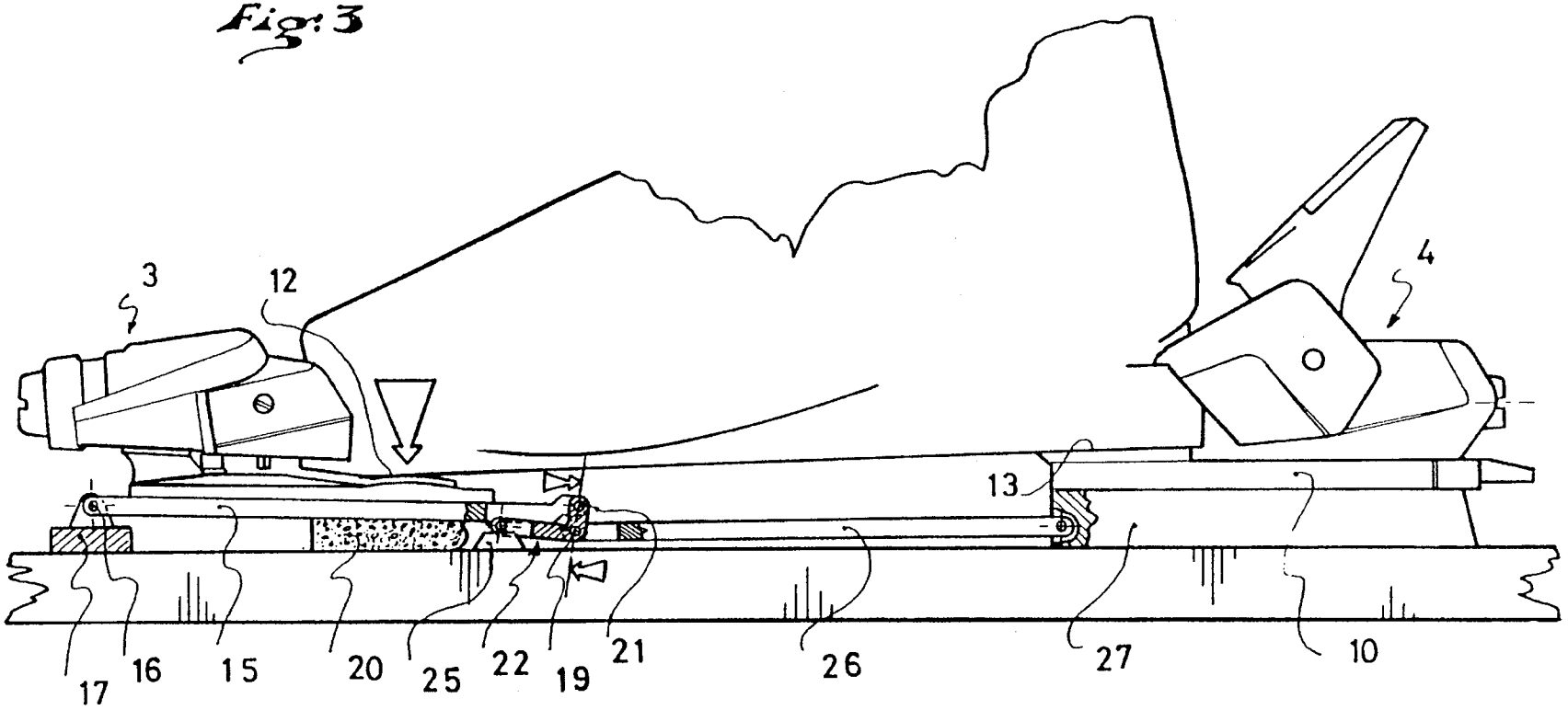
FIG. 3 is a partial exploded view of the linkage between the sensor and the different traction members for the device of FIG. 1.
Figure 4:
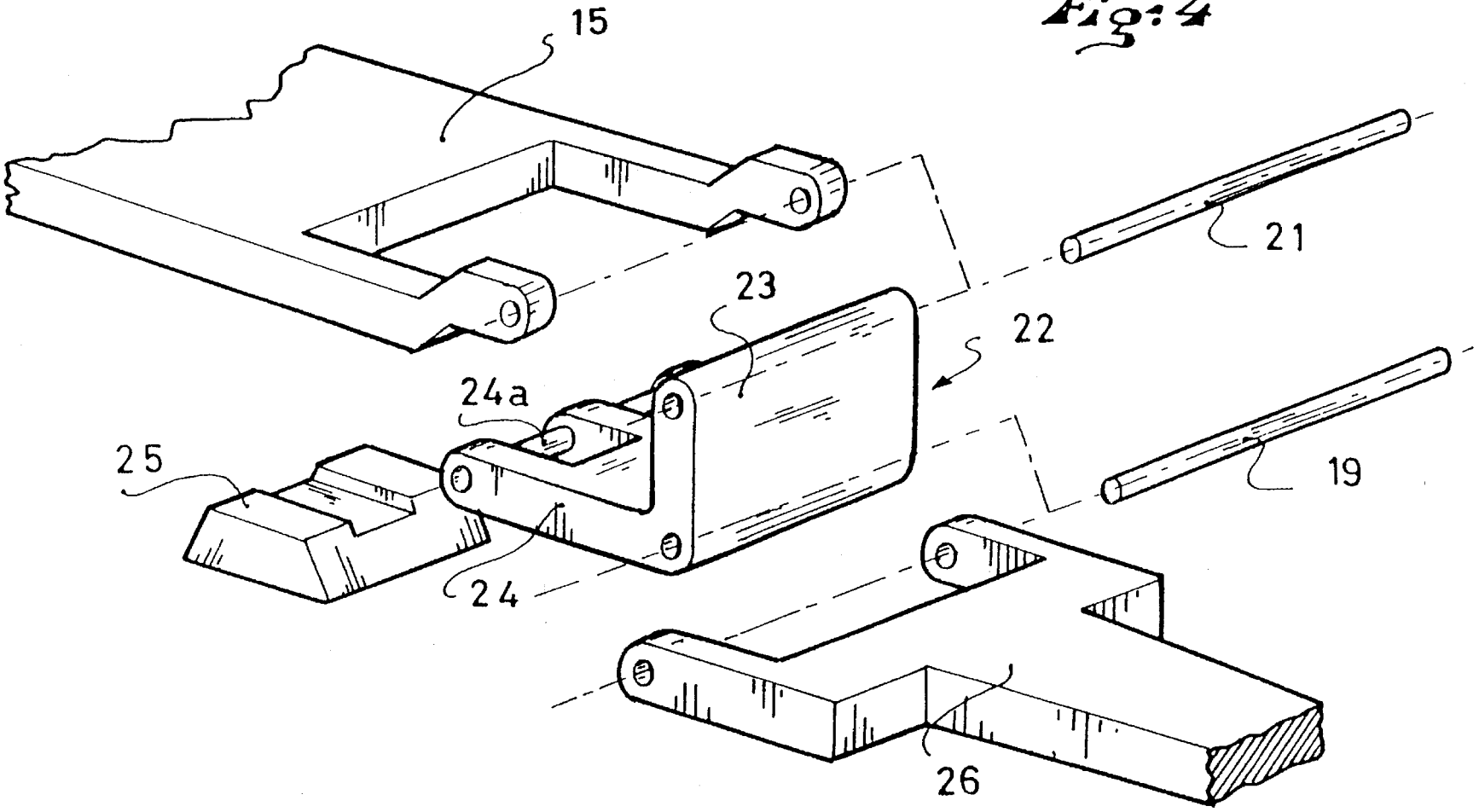
FIG. 4 represents a side view of the device of FIG. 1 subjected to a vertical bias directed on the sensor.

FIG. 3 illustrates such a functioning of the device.

As the journal of the base plate 15 to the bearing 17 is raised with respect to the upper surface of the ski, this traction bias induces in the ski a flexion moment which tends to raise the shovel and, if necessary, the rear end of the ski. The ski is thus more pivotable.

The flexion moments induced on the front and rear of the ski are more or less strong along the altitude of the axis 16 and of the pin 29, respectively, with respect to the upper surface of the ski. In particular, if the rear end of the member 26 is fixed directly to the upper surface of the ski, the flexion moment induced on the rear of the ski is negligible, and only the front end of the ski is biased upward.

One could also adopt an inverse position of the rocking device, i.e., orienting the horizontal arm 24 rearward, and inverting the position of the journals to the base plate and to the traction member. However, it is preferable to place the journal to the base plate 15 as high as possible, so that the traction bias has a vertical component that contributes to the raising of the shovel of the ski.

Figure 5:
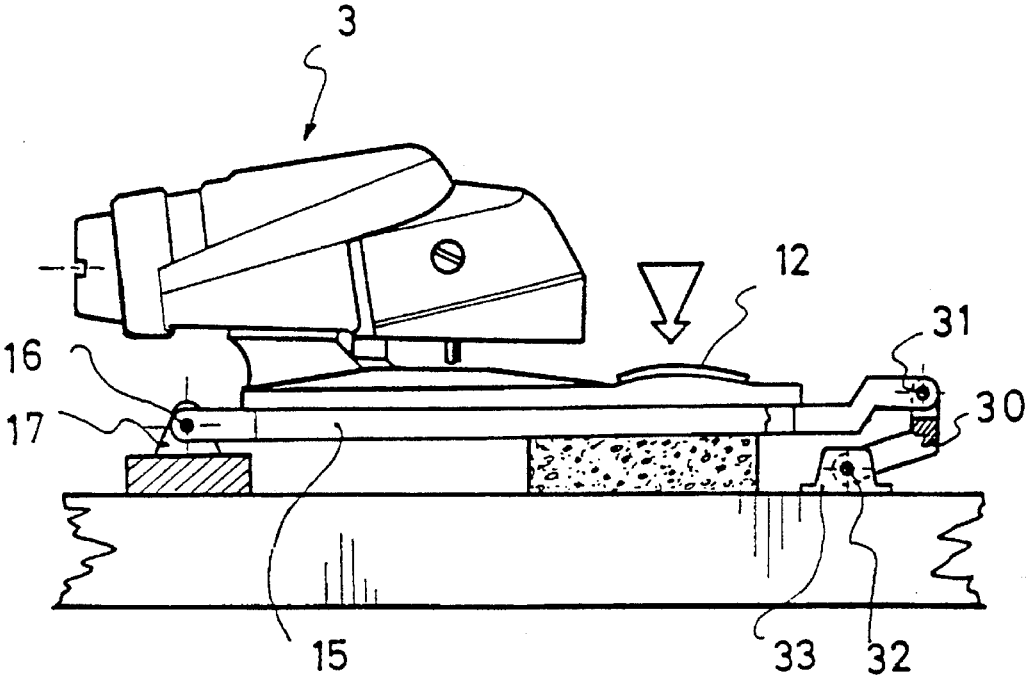
FIGS. 5–10 represent side views of the various embodiments of the invention, FIG. 8 being a top view of the device of FIG. 7.

FIG. 5 illustrates an embodiment variation of the device just described. According to this variation, the base 15 is connected to a rocking device 30 by a transverse axle 31 in the same manner as in the previous case. The rocking device 30 is however journalled here to its base about a transverse axle 32 borne by a bearing 33 affixed to the upper surface of the ski in front of the perpendicularity of the axle 31. The axle 32 is located at a height beneath that of the front axle 16.

In this manner, a vertical downward bias exerted on the support element 12 tends to apply pressure to the assembly formed by the base plate 15 and the rocking device 30. This induces a traction bias that is transmitted to the ski by the base plate 15, the axis 16 and the bearing 17. This bias induces a flexion moment which tends to raise the front end of the ski. In reaction, another bias is transmitted to the ski by the rocking device 30, the axle 32 and the bearing 33, but as axle 32 is located near the upper surface of the ski, this reaction does not have a substantial effect on the flexion of the ski.

As in the preceding case, preferably, the axle 31 is raised higher than axle 16 so that the bias applied by the base plate 15 to axle 16 has an upward vertical component.

The rocking device 30 and the axles 31 and 32 can be offset more or less far behind front binding element 3, which influences the nature and intensity of the flexion moment applied to the front end of the ski.

The rear binding element could be assembled to the ski according to the same manner of linkage to generate on the rear of the ski a flexion moment tending to raise this end.

Figure 6:
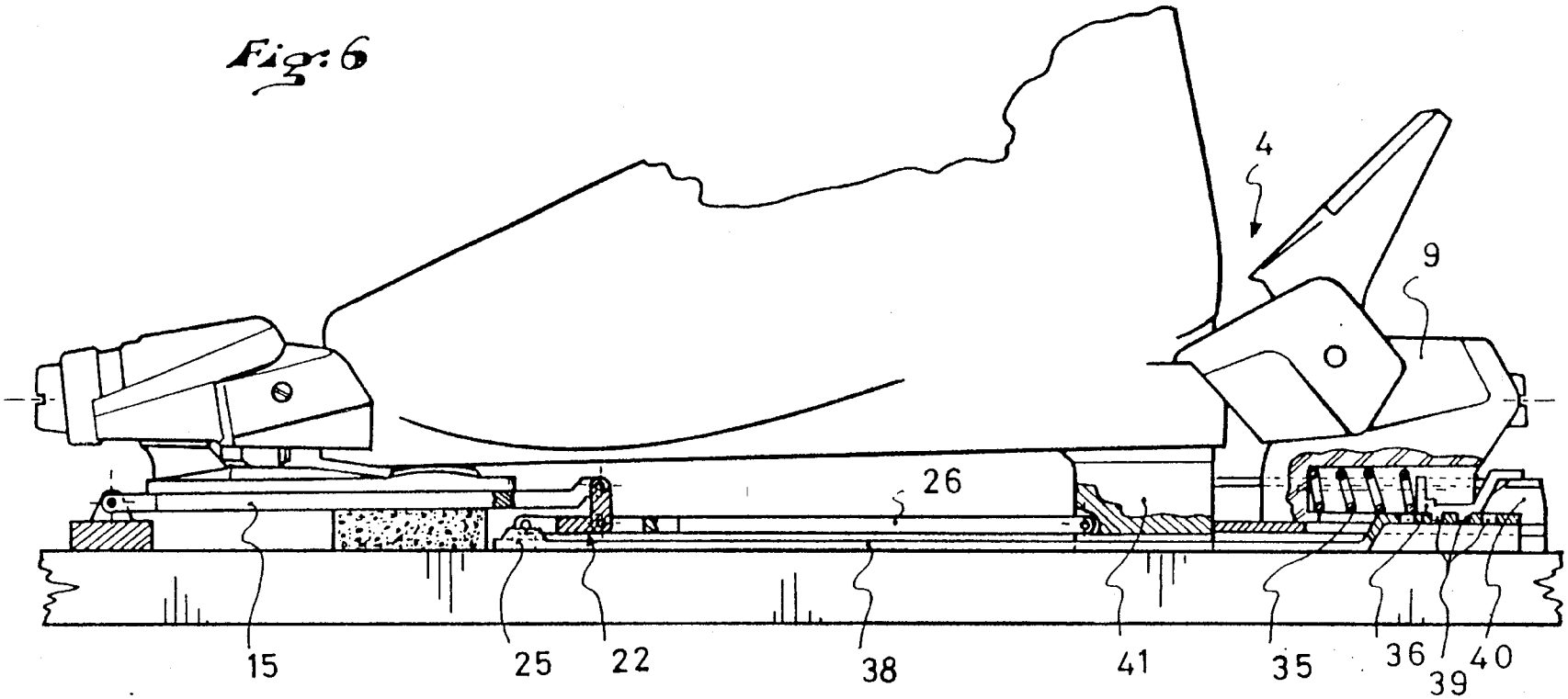

FIG. 6 illustrates another embodiment of the invention. According to this variation, the interface device is of the same type as that described relative to FIG. 1, with a front base plate 15, a rocking device 22 whose one arm is in support against a pin 25, and a traction member 26 which comes from the rear.

The principal difference lies at the mounting area of the rear binding element.

Typically, the body 9 of rear binding element 4 is slidably mounted along a slide-shaped base, and a return spring 35 housed in the body 9 pushes the body forward, in an elastic manner, by taking support with respect to a fixed point of the ski. A latch 36, or another means, also enables adjustment of the longitudinal position of the body as well as the intensity of this return thrust as a function of the length of the boot. It is the latch that obtains the linkage between the body and the ski.

The return spring has the primary function of obtaining an elastic pinching or gripping of the sole of the boot between the front and rear binding elements. This spring is also biased by compression when the ski bends; in order to absorb the differences in lengths between the ski that forms an arc, and the boot that forms the "bowstring".

However, when the binding element is affixed to the ski by its base, this return thrust generates in the ski a reaction that tends to resist the flexion of the ski. The intensity of this reaction increases with the compression of the return spring, i.e., with the flexion curvature of the ski.

According to the embodiment of FIG. 6, this reaction is canalized by an inextensible blade 38 that extends between the latch 36 and a fixed point on the ski located on the front, for example the pin 25, or in front of the latter. As is visible in FIG. 6, the blade 38 has in its rear portion a series of notches 39, and the latch 36 has teeth that penetrate in a portion of these notches. This blade brings back the return reaction on the front. It brings back this reaction preferably in the zone where the return bias has another component in the opposite direction, i.e., in the zone of the front binding element. Overall, the return stresses thus follow a circuit that for all intents and purposes does not affect the ski.

The slide 40 along which the body is slidably mounted is integrally fixed to the ski. In the embodiment illustrated, the slide has on the front the support element 13 on which the sole of the boot rests. The support element could however be connected to the body.

As for the traction member 26, it is connected by the pin 26 to the front portion 41 of the slide 40, i.e., to a fixed element on the ski.

The device functions in a manner similar to that of FIG. 1, the difference being that when the ski bends because of traction forces, the return spring does not have a tendency to compress and resist this flexion. Indeed, when the ski bends forming an arc, the body of the rear element can return because it is connected to the front of the median zone of the ski by the blade 38 that forms the "bowstring" parallel to the sole of the boot. During flexion of the ski, the drawing together of the rear binding element and the front binding element is less than in the case of FIG. 1. The flexion effect of the ski is thus improved by the fact that the return spring does not boldly resist this flexion.

Figure 7:
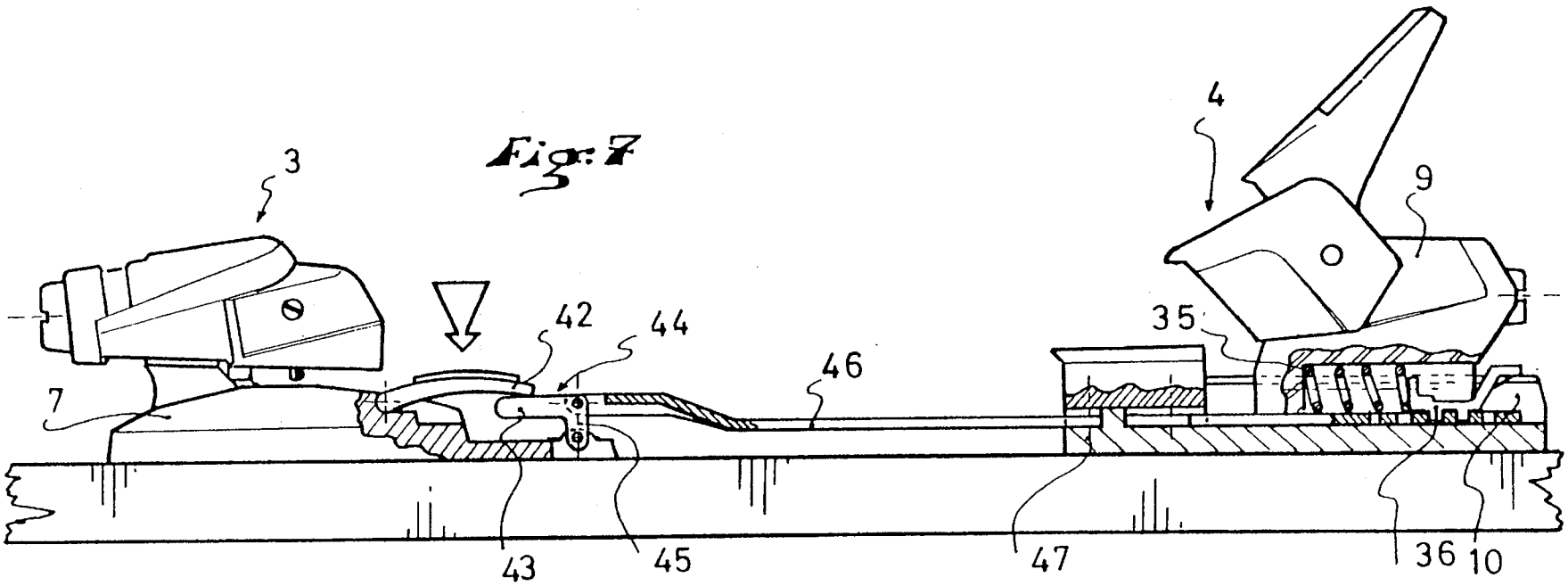
Figure 8:
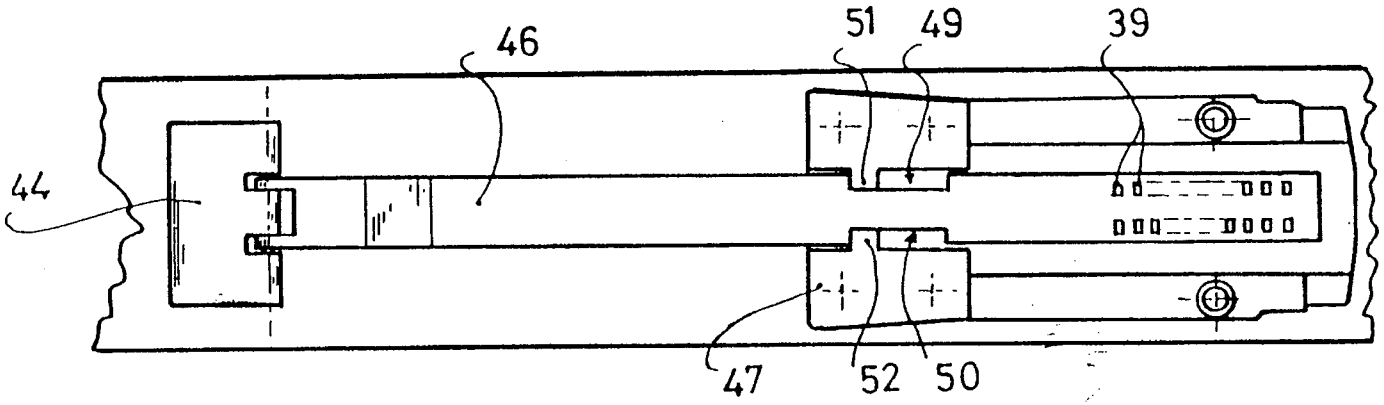

The embodiment represented in FIGS. 7 and 8 also integrates the influence of the return spring on the flexion of the ski.

According to this variation, the base 7 of the front binding element 3 is connected in a fixed manner to the ski. Likewise, the base 10 of the rear binding element is connected in a fixed manner to the ski. In the embodiment illustrated, the base 10 rises above a base plate 47. The base 10 forms the slide along which the body 9 is slidably mounted, by action of the return spring 35 that elastically biases it forwardly. The spring 35 takes support against the latch 36.

The sensor is here formed by the front support element 42 on which the front end of the boot rests. The front support element is mounted journalled in rotation about a transverse axis located towards the front of the plate. This axis can be materialized by an axis or a pin. It can also be imaginary.

The rear portion of the support element 42 rests on the horizontal arm 43 of a rocking device 44. The rocking device 44 also has a vertical arm 45 that is journalled at its base about a transverse axis borne by a bearing fixed on a ski. The bearing is for example formed by the rear portion of the base 7.

An inextensible blade 46 connects the top of the vertical arm 45 to the latch 46 of the rear binding element. Like blade 38, blade 46 has in its rear portion notches for the teeth of the latch. The latch is thus fixedly connected to the rear end of the blade 46.

An abutment serves to block the latch towards the rear. For example, this abutment is formed by the cooperation of two lateral cuttings of the blade 49 and 50 with two lateral pins 51 and 52 that rise from the base plate 47. The cuttings have a length greater than that of the pins, to enable the blade to be displaced forward relative to the pins.

This device functions in the following manner. In the presence of the boot and at a nominal rate, the return spring 35 exerts a forward thrust on the body, whose reaction maintains the latch against its abutment, i.e., the cuttings 49 and 50 of the blade are in abutment against the pins 51 and 52. The blade is, however, stretched, so as to maintain suspended the support of the support element 42 on the arm 43 of the rocking device. Thus, the return reaction is transmitted to the ski principally by the base plate 47 of the rear binding element. This reaction creates a flexion moment which tends to increase the camber of the ski, i.e., to lay flat the ends of the ski on the snow. This is known by one with ordinary skill in the art.

If a vertical bias of strong intensity is applied on support element 42, this bias is sent back by the rocking device 44 in the blade 46 in the form of a forward bias. If this bias has a sufficient intensity, it can displace the blade 46 forward by compressing the spring 35 in an additional manner. This being so, the latch leaves its retention abutment, i.e., the cuttings 49 and 50 disengage from the pins 51 and 52. The return reaction is no longer transmitted to base plate 47, but it is integrally canalized by the blade 46 towards the base 7. The return effect on the flexion of the ski wears away, i.e., the ski is less biased at flexion and therefore becomes more pivotable because its front and rear ends are relieved.

If the bias intensity decreases, the blade relaxes its traction on the latch, and the return reaction is progressively retransmitted to the ski by the base plate 47. The ends of the ski are again biased in flexion against the snow.

Figure 9:
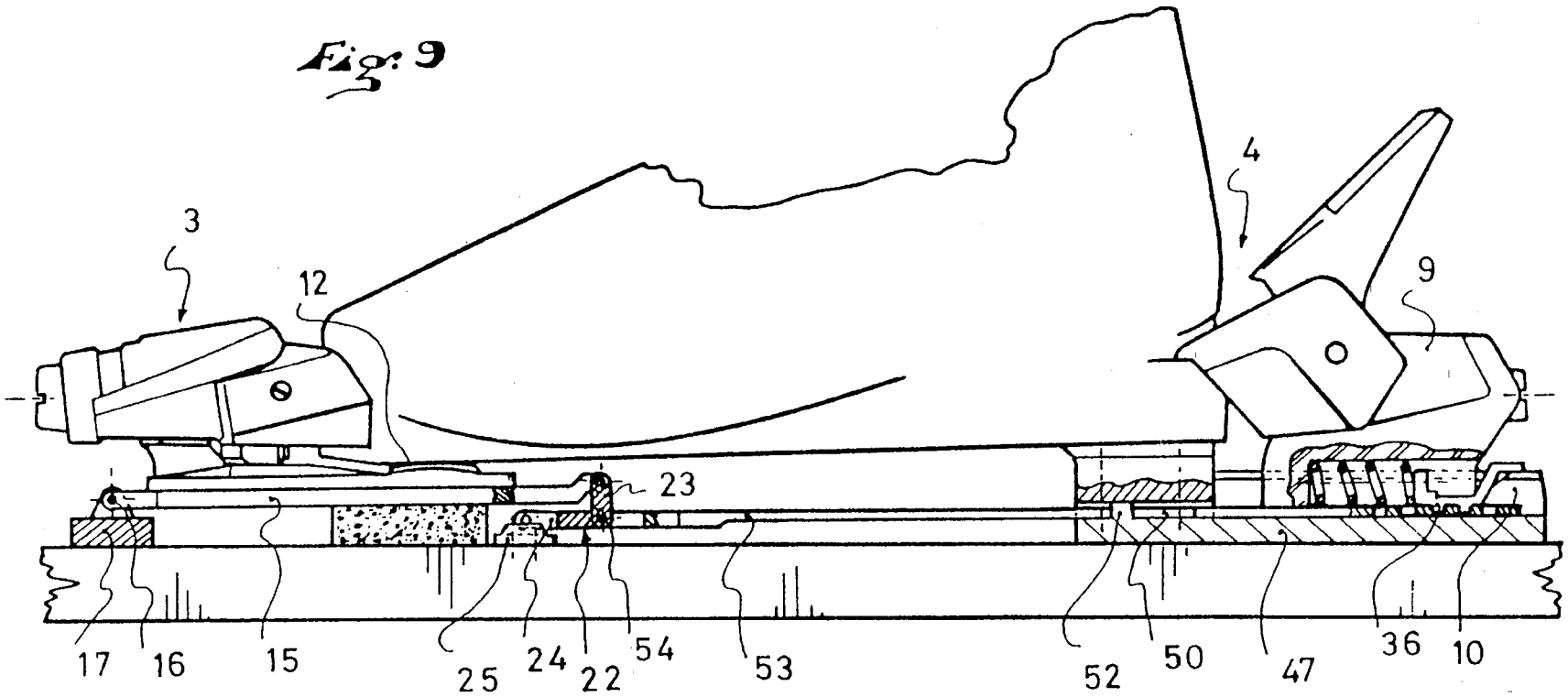

According to the variation represented in FIG. 9, the two effects previously described are combined. The front portion of the device is similar to that of FIG. 6, with a base plate 15 journalled about an axle 16 to a bearing 17. The rear of the base plate 15 is connected to a rocking device.

The rear portion of the device is similar to that described with respect to FIGS. 7 and 8, with the body 9 slidably mounted along a slide 10 affixed to the ski, a blade 53 on which the latch 36 is engaged, and the abutment formed by the cuttings of the blade 53 cooperates with the pins 51, 52 of the base plate 47.

According to this variation, the blade 53 is connected towards the front to the base of the vertical arm of the rocking device. As the base plate is connected to the top of this vertical arm, and the horizontal arm of the rocking device is in support against the pin 25, a vertical bias on the sensor causes both a bias that is transmitted to the bearing 17 and to the ski in the form of a flexion moment tending to raise the shovel, and a transfer of the return reaction towards the front of the median zone of the ski, which improves the bending aptitude of the ski in the direction of a rise of its ends.

Figure 10:
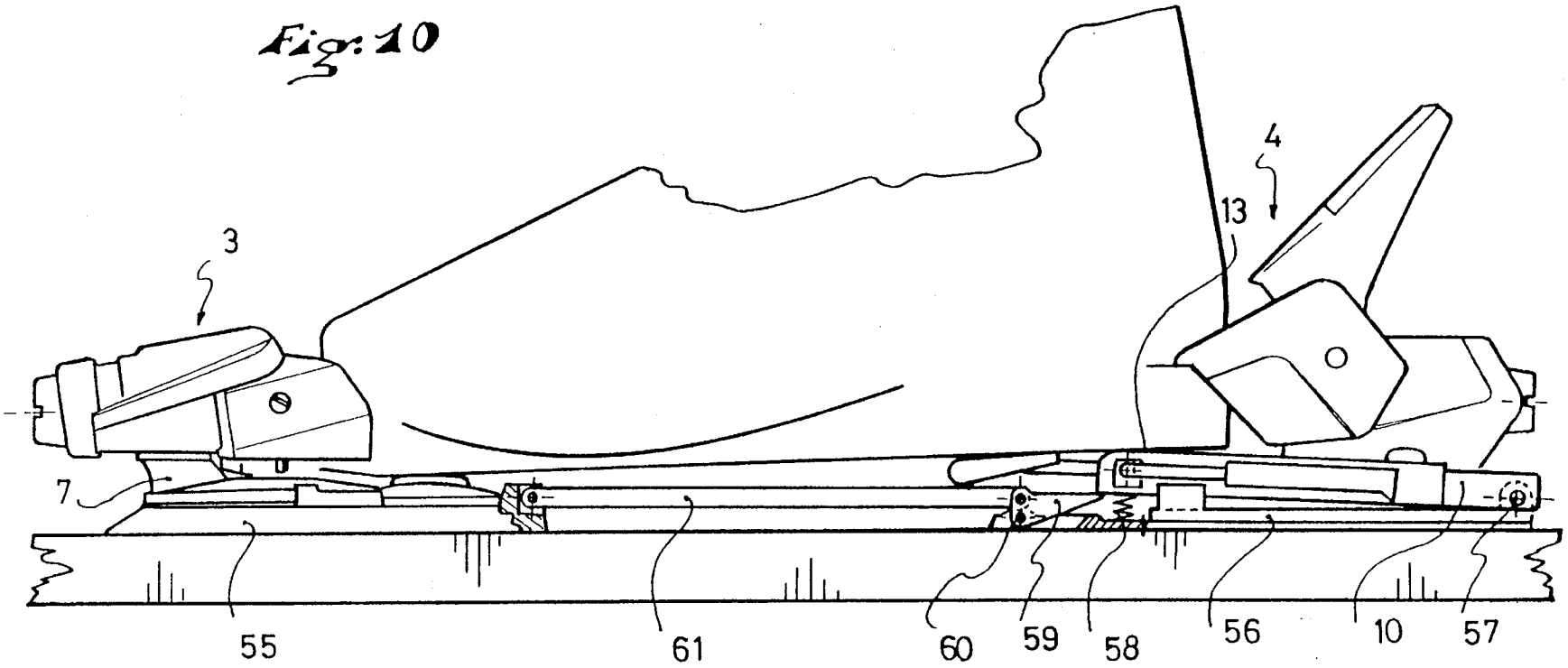

The sensor that captures the biases of the boot can also be located in the rear of the boot. To illustrate this, FIG. 10 represents an interface device connected to a front binding element 3 mounted on a base plate 55 connected in a fixed manner to the upper surface of the ski. In addition, the slide 10 of the rear binding element is mounted journalled about a transverse axis 57 borne by a base plate 56 affixed to the ski. Possibly, a spring 58 or another elastic means elastically resists the downward rocking of the slide 10.

The front portion of the base, which comprises the support plate 13, is maintained raised, and it rests on the horizontal arm of a rocking device 59. The rocking device is journalled at its base with respect to the ski, for example about an axis 60 borne by the base plate 56.

A traction member 61 also connects the rocking device 57 and the base plate 55, so as to transform the vertical bias captured by the support element 13 into rearward traction biases exerted on the base 55. As a variation, the traction member could be connected to an element affixed to the ski and distinct from the base 7 or from the base plate 55, for example a bearing such as the bearing 17.

The instant application is based upon French patent application 94.01898 of Feb. 16, 1994, and is also related to French patent application 91.10895 of Aug. 27, 1991, now French Publication No. 2,680,697, published on Mar. 5, 1993, the disclosures of which are hereby expressly incorporated by reference thereto, and the priorities of which are hereby claimed. Further, French application No. 91.10895 is the priority application of U.S. Pat. No. 5,332,253, issued on Jul. 26, 1994.

Finally, although the invention has been described with reference of particular means, materials and embodiments, it is to be understood that the invention is not limited to the particulars disclosed and extends to all equivalents within the scope of the claims.

What is claimed:

1. An interface device between a ski boot and a ski to modify the natural pressure distribution of the ski on the snow, the device adapted for connection to a median zone of the ski, and to a front binding element and a rear binding element, each binding element comprising a respective base by which each respective binding element is connected to the ski, a body borne by the base, and a support element on which the sole of the boot rests, the rear binding element being mounted on its said respective base adapted to be affixed to the ski, and having a latching means enabling adjustment of the longitudinal position, wherein said interface device comprises:

a mobile sensor for capturing vertical biases of the boot;

a return rocking device arranged to transform the vertical biases captured by said sensor into a horizontal traction force;

a bearing provided to be affixed to the ski towards one end of the ski, said bearing-having a linkage zone located above the upper surface of the ski; and a linkage element connecting said return rocking device to said linkage zone of said bearing for transmitting the horizontal traction force to the ski by means of said bearing.

2. A device according to claim 1, wherein:

said sensor is the support element connected to the front binding element on which the front portion of the sole of the boot rests.

3. A device according to claim 2, wherein:

the linkage element is a base plate located in front of the rocking device and having at an upper surface a mounting zone for the base of the front binding element, the front of said base plate being journalled to said linkage zone of said bearing about a transverse direction, and the rear of said base plate being connected to said return rocking device.

4. A device according to claim 3, wherein:

a block of elastically deformable material is interposed between said base plate and the upper surface of the ski.

5. A device according to claim 3, wherein:

said rocking device comprises two arms, said two arms comprising a vertical arm and a horizontal arm, said vertical arm having two journals, the horizontal arm having one free end;

said device further comprising a traction member that extends between said rocking device and rear binding element, the traction element being connected to one of the two said journals of said rocking device, and to a member of the rear retention element.

6. A device according to claim 5, further comprising:

a pin adapted to be affixed to the ski, the pin being located beneath the end of said free end of said horizontal arm.

7. A device according to claim 6, further comprising:

a linkage blade extending from said pin towards the rear binding element, and having on the rear a toothing provided for the latching means of the rear binding element.

8. A device according to claim 5, wherein:

said traction member has on the rear a toothing provided for the latching means of the rear binding element.

9. A device according to claim 8, wherein: said traction member has an abutment in front of said toothing, the base plate of the rear binding element having a second abutment, said abutment of said traction member being provided to come in front to rear support against said abutment of the base plate of the rear binding element.

10. A device according to claim 3, further comprising:

a second bearing provided to be affixed to the ski approximately beneath the sensor; and a journal borne by said second bearing;

said rocking device being an arm connected at one end to said linkage member and at the other end to said bearing.

11. A device according to claim 3, further comprising: a base plate located beneath the rear binding element, a traction member extending between said rocking device and said rear base plate;

the traction member having in the front a journal zone with said rocking device, and in the rear a linkage zone with said rear base plate; and a pin adapted to be affixed to the ski that is located beneath one free arm of said rocking device.

* * * * *